United States Patent [19]

Price et al.

[11] 4,035,792

[45] July 12, 1977

[54] CASH REGISTER SECURITY SYSTEM

[76] Inventors: Robert L. Price, 2323 Elden, Apt. 26, Costa Mesa, Calif. 92627; Edward R. Davenport, Jr., 324 Pirate Road, Newport Beach, Calif. 92663

[21] Appl. No.: 699,948

[22] Filed: June 25, 1976

[51] Int. Cl.[2] ..... G08B 13/02

[52] U.S. Cl. ..... 340/277; 70/87; 109/54; 235/22; 235/128; 340/280

[58] Field of Search ..... 340/277, 280; 70/87, 70/85; 109/54, 53; 235/22, 128

[56] References Cited

U.S. PATENT DOCUMENTS

| | | | |
|---|---|---|---|
| 1,696,522 | 12/1928 | Clegg et al. | 340/277 |
| 1,900,519 | 3/1933 | Piani | 235/22 |
| 1,964,353 | 6/1934 | Hodos | 340/277 |
| 2,508,159 | 5/1950 | Haas | 70/85 |
| 2,650,023 | 8/1953 | Aurbach et al. | 235/22 |

*Primary Examiner*—Glen R. Swan, III
*Attorney, Agent, or Firm*—Raymond L. Madsen

[57] ABSTRACT

A cash register security system has a first latch normally adapted to engage and securely hold within a cash register a false drawer, a release device connected to the first latch for releasing the first latch from engaging and holding the false drawer within the cash register, a second latch adapted to engage and hold within the cash register a cash drawer, the second latch normally being in disengagement with the cash drawer, a locking device connected to the second latch for locking the second latch in engagement with the cash drawer and holding the cash drawer within the cash register, an alarm circuit connected to the release device and the locking device and an alarm switch connected to the alarm circuit for operating the alarm circuit and activating the release device and the locking device whereby the cash drawer is locked within the cash register and only the false drawer may be ejected from the cash register after the alarm switch is operated. A police silent alarm, a plurality of cameras and a flashing beacon also are connected to and operated by the alarm switch.

10 Claims, 2 Drawing Figures

CASH REGISTER SECURITY SYSTEM

BACKGROUND OF THE INVENTION

The present invention relates to a security and alarm systems and more particularly to security systems for cash registers.

In the field of protective equipment for cash registers, cash drawers, and the like, it has been the general practice to employ combinations of alarm switches such as that disclosed in U.S. Pat. No. 2,276,632, granted to F. C. W. Stelter, et al., to operate an alarm circuit when a drawer of the cash register is opened without the pressing of a selected key on the cash register. Another form of robbery alarm system which has been proposed is an electrical alarm system wherein an electrical circuit has a pair of fixed contacts which are connected by a conductive wrapper about a stack of currency. When the stack is removed from the contacts, a holding circuit is broken and an alarm device activated. Although such devices have served the purpose, they have not proven entirely satisfactory under all conditions of service for the reason that although an alarm is activated when the drawer is not properly operated or the stack of currency is removed, the cash contents of the drawer nevertheless are exposed and subject to possible loss before a response to the alarm is initiated.

Those concerned with the development of cash registers have long recognized the need for a cash register which would not release or expose the cash contents thereof under an attempted robbery or alarm condition but would eject only a false drawer instead. The present invention fulfills this need.

One of the most critical problems confronting designers of cash register alarm systems has been the lack of capability of the system to aid in the identification, apprehension and capture of the violator of the security system. This problem is overcome by the present invention.

A further problem of alarm systems installed in business establishments to alert law enforcement groups that a robbery is taking place is the need for a local non-audible alarm which alerts patrolling law enforcers but not the criminal. The present invention overcomes this problem.

SUMMARY OF THE INVENTION

The general purpose of this invention is to provide a cash register security system which embraces all the advantages of similarly employed alarm systems and attachments and possesses none of the aforedescribed disadvantages. To obtain this, the present invention contemplates a unique cash drawer locking and false drawer release arrangement such that when an alarm switch is operated, only the false drawer may be ejected from the cash register and revealing of the cash contents of the register is avoided.

An object of the present invention is the provision of a cash register security system which only releases a false drawer when the cash register is improperly operated by unauthorized personnel.

Another object is to provide an alarm system for a cash register which releases a false drawer in the register for ejection therefrom while activating a police silent alarm.

A further object of this invention is the provision of a cash register alarm system which locks all of the cash drawers and permits only the ejection of a false drawer when the alarm system is operated and further activates a police silent alarm and a camera with self-developing film for photographing the unauthorized intrusion into and violation of the security system.

Still another object is to provide a cash register security system which activates a police silent alarm, a multiplicity of cameras with self-developing film, locking devices for the cash drawers of the cash register, a flashing beacon located in a conspicuous place and a release device for a drawer containing treated or marked money.

BRIEF DESCRIPTION OF THE DRAWING

Other objects and many of the intended advantages of this invention will be readily appreciated as the same becomes better understood by reference to the following detailed description when considered in connection with the accompanying drawings in which like reference numerals designate like parts throughout the figures thereof and wherein.

DESCRIPTION OF THE PREFERRED EMBODIMENT

Figure 1:
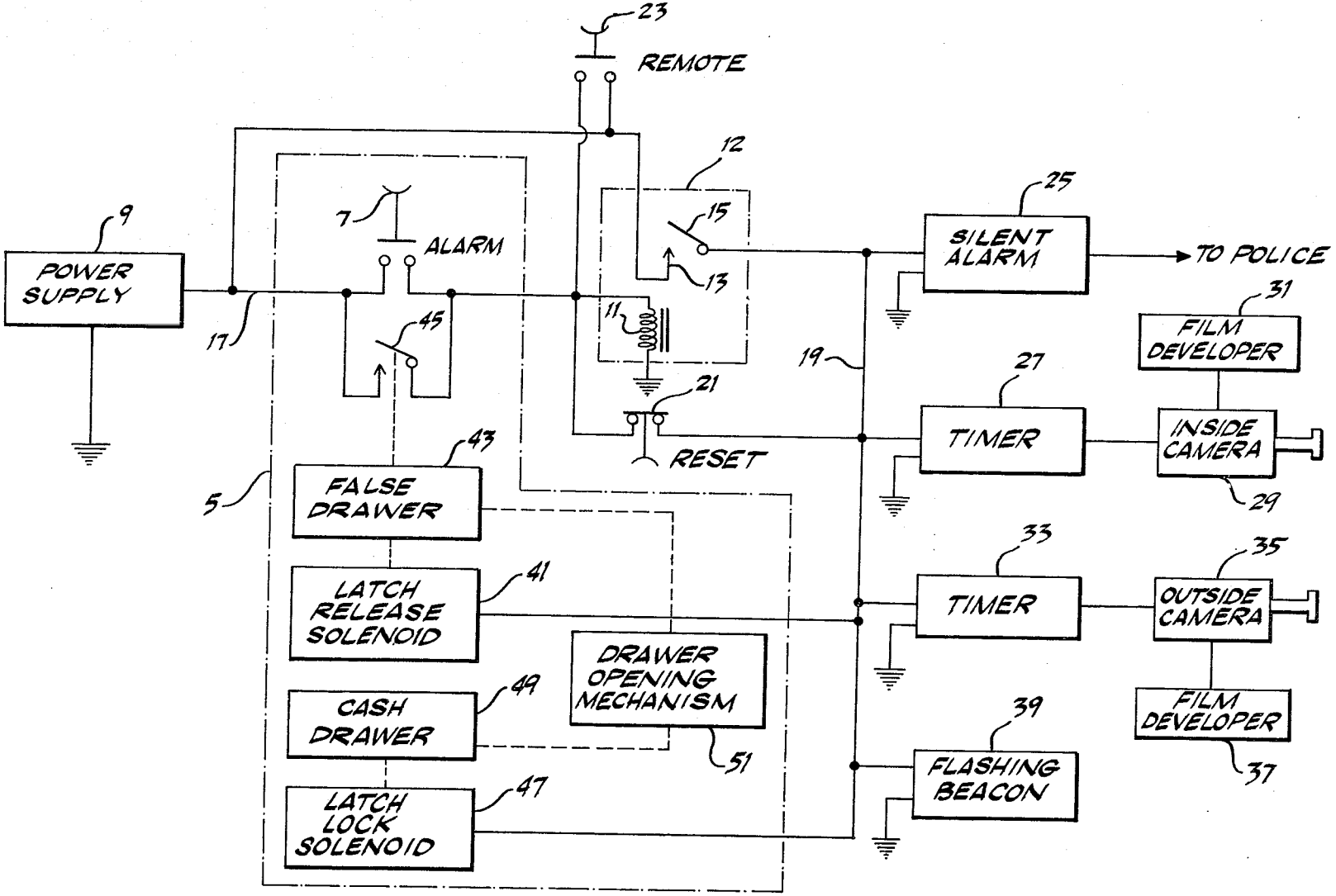
FIG. 1 illustrates a combination circuit and block diagram, both electrical and mechanical, of a preferred embodiment of the present invention.

Referring now to the drawings, wherein like reference characters designate like or corresponding elements throughout the several figures, there is shown in FIG. 1 (which illustrates a preferred embodiment) a cash register 5 having an alarm button 7 connected between a power supply 9 and a solenoid coil 11 of a relay 12 having a fixed contact 13 and a moving contact 15 thereon. Contact 13 is connected to output 17 of power supply 9 and contact 15 is connected to a buss line 19. A normally closed reset button switch 21 is connected between line 19 and the junction between alarm button 7 and solenoid coil 11. A remote button switch 23 is connected in parallel with alarm button 7. A silent alarm system 25 is connected to line 19 which in turn is connected to police headquarters. A timer 27, which could be electronic or mechanical, is connected to line 19 and is further connected to operate an inside camera 29 which in turn has an automatic film developer 31 attached thereto. Another timer 33, similar to timer 27, is connected to line 19 and is further connected to operate an outside camera 35 which in turn is connected to a film developer 37, similar to film developer 31. Line 19 is further connected to a flashing beacon 39 and a latch release solenoid 41 within cash register 5 to normally secure a false drawer 43 mechanically within the cash register. A latch lock solenoid 47 also is connected to line 19 and under an alarm condition locks a cash drawer 49 within cash register 5. A drawer opening or ejecting mechanism 51 conventionally opens cash drawer 49 while false drawer 43 is held by latch release solenoid 41 within the cash register. When line 19 is connected to power supply 9, false drawer 43 is released for ejection by drawer opening mechanism while cash drawer 49 is securely held by latch lock solenoid 47 within cash register 5. A microswitch 45 is connected in parallel with alarm button 7 and is normally held open by false drawer 43 positioned within cash register 5. When false drawer 43 is ejected, micro-switch 45 is closed to apply power to solenoid coil 11 as long as drawer 43 is extended from cash register 5.

Figure 2:
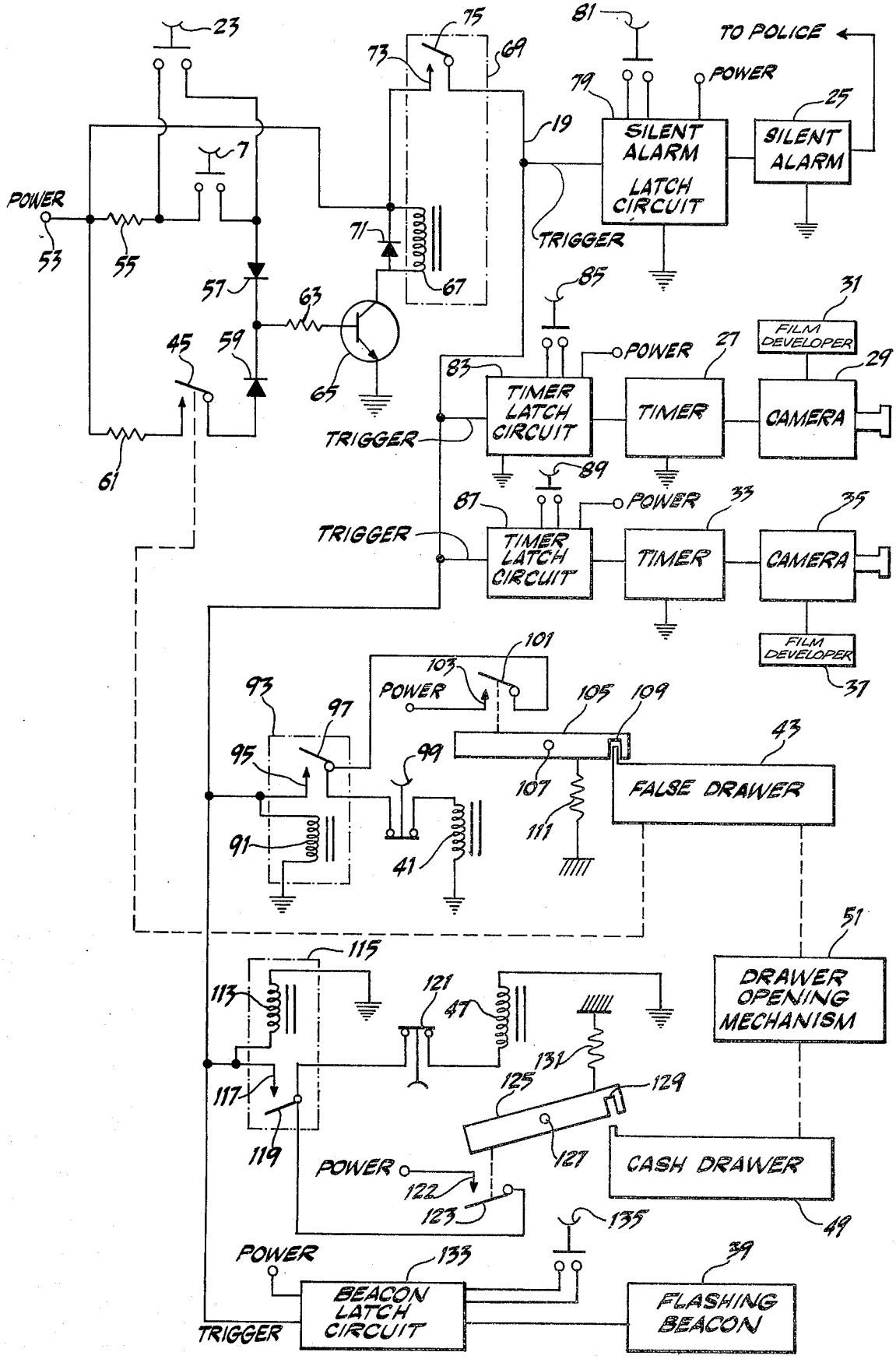
FIG. 2 shows a more detailed alternative electrical circuit partially in block diagram including drawer release and locking elements for the system of FIG. 1.

Turning now to FIG. 2, there is illustrated a power supply terminal 53 connected to a resistor 55 which in turn is connected through alarm button 7 in parallel with remote button 23 to the anode of a diode 57 which in turn has the cathode thereof connected to the cathode of a diode 59, the anode thereof being connected through switch 45 to a resistor 61 which in turn is connected back to power supply terminal 53. The junction of diodes 57 and 59 is connected through a resistor 63 to the base of an npn transistor 65, the emitter of which is connected to circuit ground and the collector thereof being connected to one end of a coil 67 of a relay 69 and to the anode of a diode 71 connected across coil 67. The other end of coil 67 and the anode of diode 71 are connected back to power supply terminal 53. A fixed contact 73 of relay 69 is connected to the cathode of diode 71 and a moving contact 75 of relay 69 is connected to a buss line 19 which in turn is connected to the trigger input of a silent alarm latch circuit 79 having a reset button 81 connected thereto, latch circuit 79 being connected in turn to silent alarm system 25. A timer latch circuit 83, having a reset button 85 connected thereto, has a trigger input connected to buss line 19 and has an output connected to timer 27 which operates camera 29 and film developer 31. Buss line 19 is further connected to the trigger input to a timer latch circuit 87 having a reset button 89 connected thereto, timer latch circuit 87 being further connected to activate timer 33 which in turn operates camera 35 and film developer 37. A solenoid coil 91 of a relay 93 is connected between buss line 19 and circuit ground, relay 93 having a normally open fixed contact 95 and a moving contact 97 thereof, fixed contact 95 being connected to buss line 19 and moving contact 97 being connected through a normally closed reset button switch 99 to latch release solenoid 41 which in turn is connected to circuit ground. Associated with latch release solenoid 41 are a normally open fixed contact 103 and a moving contact 101, fixed contact 103 being connected to power supply terminal 53 and moving contact 101 being connected to moving contact 97 of relay 93. A latch mechanism 105 operated by solenoid 41 pivots about pivot pin 107 and has a notch 109 normally held in engagement with false drawer 43 by a spring 111.

Similarly buss line 19 is connected through a solenoid coil 113 of a relay 115 to circuit ground. A fixed contact 117 of a relay 115 is connected to buss line 19 and a moving contact 119 of relay 115 is connected through a normally closed button switch 121 to latch lock solenoid coil 47 which in turn is connected to circuit ground. Associated with latch solenoid 47 is fixed contact 122 conncected to power supply terminal 53 and a normally open moving contact 123 connected to moving contact 119 of relay 115. A latch 125 is operated by solenoid 47 and pivots about pivot pin 127 and further has a notch 129 therein which is normally positioned disengaged from cash drawer 49 by a spring 131.

A beacon latch circuit 133 has an input trigger connected to to buss line 19 and further has a reset button 135 connected thereto. Beacon latch circuit 133 is further connected to flashing beacon 39.

Operation of the invention can best be described by referring first to FIG. 1. Under normal use, cash register 5 is operated by drawer opening mechanism 51 which ejects cash drawer 49 from the cash register for normal or ordinary transactions of business. During normal operation, false drawer 43 is engaged and held by latch release solenoid 41 within the cash register and cannot be ejected therefrom. Upon an attempted robbery, theft or unauthorized operation of the cash register, alarm button 7 or remote button 23 is depressed causing relay 12 to be operated closing moving contact 15 to fixed contact 13 thereby applying power from power supply 9 to buss line 19. This results in latch release solenoid 41 being operated to release or unlock false drawer 43 and operation of latch lock solenoid 47 to lock or engage and hold cash drawer 49. Consequently, when drawer opening mechanism 51 is operated, the false drawer is ejected from cash register 5 and cash drawer 49 is securely held within. False drawer 43 may contain marked bills or chemically or specially treated cash such that when it is removed, it can be easily traced and the holder thereof readily apprehended. Consequently, the cash which is accumulated in cash drawer 49 is protected from unauthorized access.

In addition to activating the latch release 41 and latch lock 47 within cash register 5, a silent alarm 25 is activated by relay 12 to alert police that unauthorized operation of cash register 5 has been initiated. In addition, cameras 29 and 35 are activated by timers 27 and 33, respectively, such that timed picture frames are exposed which show the area within the building where the cash register is located and also a predetermined area outside the building. Cameras 29 and 35 may be movie cameras operated by timers 27 and 33, frame-by-frame to conserve film. Timers 27 and 33 may be electronic or mechanical circuits well known to those skilled in timing devices regulated to operate cameras 29 and 35 on a frame-by-frame basis at any speed desired. To enable rapid identification of an undersired intruder, the exposed film in cameras 29 and 35 is automatically developed in film developers 31 and 37, such film developers being well known in the field of space exploration photography. It should also be noted that cameras 29 and 35 may be still cameras.

Flashing beacon 39 may be positioned outside the building where the cash register is located, in a place readily observed by cruising law enforcers or the general public.

As long as false drawer 43 is extended from cash register 5, micro-switch 45 remains closed, by-passing alarm button 7 and keeping power supplied to solenoid coil 11 of relay 12. After false drawer 43 is returned and repositioned inside the cash register, reset button 21 then can be depressed to release moving contact 15 from fixed contact 13 thereby removing power from buss line 19 and the associated silent alarm, timers, and flashing beacon, latch release solenoid and latch lock solenoid. The system is then ready to be activated by depressing alarm button 7 or remote button 23.

Turning now to FIG. 2, depressing remote push button switch 23 or push button switch 7 mounted on the cash register places the system into alarm condition. Current is applied through resister 55, diode 57 and resistor 63 to the base of transistor 65. Collector current from transistor 65 flows through solenoid coil 67 to close moving contact 75 against fixed contact 73 of relay 69, applying power to line buss 19, which in turn triggers silent alarm latch circuit 79, timer latch circuit 83, timer latch circuit 87 and beacon latch circuit 133, thereby operating silent alarm 25, timer 27, timer 33, and flashing beacon 39, respectively. Therefore, as described hereinabove with respect to FIG. 1, the silent alarm system is activated to alert police that the cash register is being opened by unauthorized personnel and the timers are activated to operate the cameras. In addition power is applied to solenoid coil 91 of relay 93 to close moving contact 97 against fixed contact 95 which in turn applies power through normally closed push button switch 99 to solenoid coil 41 thereby rotating latch arm 105 about pin 107 against spring 111, thereby releasing security drawer 43 from notch 109, and closing moving contact 101 against fixed contact 103 to apply power through push button switch 99 to solenoid coil 41, keeping solenoid coil 41 operated even though power may be removed from solenoid coil 91 of relay 93. Normally closed push button 99 is used to reset latch release solenoid 41.

Solenoid coil 113 is operated from buss line 19 to close moving contact 119 against fixed contact 117 to apply power through normally closed push button switch 121 to latch solenoid 47 which in turn rotates latch arm 125 about pin 127 such that notch 129 engages cash drawer 49 to hold and lock it securely within the cash register. Spring 131 moves latch arm 125 into disengagement with cash drawer 49 when the system is reset. In addition moving contact 123 mates with fixed contact 122 to apply power through push button switch 121 to solenoid 47 until the system is reset. This portion of the system is reset by depressing push button switch 121 thereby removing power from the solenoid coil to allow latch arm 125 to be rotated about pin 127 by spring 131 and to open moving contact 123 from fixed contact 122. Each of the latch circuits is reset by their respective push button switches connected thereto.

Latch circuits 79, 83, 87 and 133 may be either electronic or electromagnetic bi-stable devices with push button reset switches, well known in the fields of electrical and electronic engineering.

Therefore, in summary, when a hold-up or robbery occurs, the cashier operates the alarm button on the cash register along with the drawer opening mechanism, only the false drawer will be ejected from the cash register. Chemically treated or marked money placed in the false drawer will be the only items available for removal from the cash register enabling the trailing and identification of the taker and the protection of the cash in the register. Until the system is reset, no other drawer in the cash register can be operated and ejected therefrom.

It should be noted that power supply 9 may be of the battery type for continuous operation during power failure. It is also contemplated that the cameras 27 and 33 may be of the infrared type for use in low lighted areas.

It now should be apparent that the present invention provides a block diagram circuit arrangement which provides a circuit arrangement which may be employed in conjunction with a cash register for releasing a selected drawer from the cash register while locking all other drawers, for alerting the police, for photographing unauthorized personnel who may be operating the cash register, and for activating a flashing beacon outside the premises on which the cash register is located to alert authorities.

Although particular components, etc., have been discussed in connection with a specific embodiment of a security system constructed in accordance with the teachings of the present invention, others may be utilized, furthermore, it will be understood that although an exemplary embodiment of the present invention has been disclosed and discussed, other applications of circuit arrangements are possible and that the embodiments disclosed may be subjected to various changes, modifications and substitutions without necessarily departing from the spirit of the invention.

What is claimed is:

1. A security system for a cash register having at least two drawers and a drawer opening mechanism comprising:

a first latch normally adapted to engage and hold within a cash register a false drawer thereby securing the false drawer within the cash register;

release means connected to said first latch for releasing said first latch from engaging and holding the false drawer from within the cash register;

a second latch adapted to engage and hold within the cash register a cash drawer, said second latch normally being in disengagement with the cash drawer;

locking means connected to said second latch for locking said second latch in engagement with the cash drawer and holding the cash drawer within the cash register;

an alarm circuit connected to said release means and said locking means for activating said release means and said locking means, respectively; and an alarm switch means for operating said alarm circuit whereby when the alarm switch is operated only the false drawer may be ejected from the cash register.

2. The security system described in claim 1 further including silent alarm means connected to and activated by said alarm circuit when an alarm switch means is operated.

3. The security system described in claim 2 further including camera means connected to and operated by said alarm circuit when said alarm switch is operated.

4. The security system described in claim 3 further including flashing beacon means connected to and operated by said alarm circuit when said alarm switch is operated.

5. The security system described in claim 1 further including remote switch means connected and parallel with said alarm switch means and mounted in a remote location from the cash register whereby said alarm circuit may be operated from said remote location.

6. The security system described in claim 5 further including normally open switch means operated and closed by the false drawer being ejected from the cash register, said normally open switch means being connected and parallel with said alarm switch means and said remote switch means whereby said normally open switch means maintains said alarm circuit in operation as long as the false drawer is extended from the cash register.

7. The security system described in claim 3 wherein said camera means includes:

a plurality of self-developing film cameras; and a plurality of timer means of which one of each is connected between said alarm circuit and one of each of said plurality of cameras for operating each camera picture frame-by-frame in a timed sequence whereby film is conserved.

8. The security system described in claim 3 wherein said alarm circuit includes a relay which is adapted to connect a source of power to said silent alarm means, said camera means, and said flashing beacon means.

9. The security system described in claim 8 wherein said silent alarm, said camera means, and said flashing beacon means each include bi-stable latching means which maintains said silent alarm means, said camera means and said flashing beacon means in operation until each bi-stable latching means is reset.

10. The security system described in claim 1 further including, treated money for insertion into the false drawer whereby said money may be readily traced and identified.

* * * * *